US006198399B1

(12) United States Patent
Mattis

(10) Patent No.: US 6,198,399 B1
(45) Date of Patent: Mar. 6, 2001

(54) SMOKE DETECTOR TEST DEVICE AND METHOD FOR MANUFACTURE

(76) Inventor: Martin P. Mattis, PMB #201, 90 Alexandria Pike, Ste. 19, Ft. Thomas, KY (US) 41075

( * ) Notice: Subject to any disclaimer, the term of this patent is extended or adjusted under 35 U.S.C. 154(b) by 0 days.

(21) Appl. No.: 09/521,301

(22) Filed: Mar. 9, 2000

(51) Int. Cl.[7] ..... G08B 17/10

(52) U.S. Cl. ..... 340/628; 340/514; 340/515; 340/693.6; 340/693.8

(58) Field of Search ..... 340/628, 693.8, 340/693.6, 514, 515; 356/438

(56) References Cited

U.S. PATENT DOCUMENTS

| | | | | |
|---|---|---|---|---|
| D. 275,183 | | 8/1984 | Minozzi, Jr. . | |
| 3,900,795 | * | 8/1975 | Larsen et al. | 324/158 R |
| 4,271,693 | * | 6/1981 | Bute | 73/1 G |
| 4,301,674 | | 11/1981 | Haines et al. . | |
| 4,306,575 | * | 12/1981 | Minozzi, Jr. | 131/329 |
| 4,330,428 | | 5/1982 | Clifford . | |
| 4,901,056 | * | 2/1990 | Bellavia et al. | 340/514 |
| 5,189,399 | | 2/1993 | Beyersdorf . | |
| 5,361,623 | | 11/1994 | Wantz . | |
| 5,523,744 | | 6/1996 | Wieser . | |
| 5,611,620 | * | 3/1997 | Wantz | 374/1 |
| 5,670,946 | | 9/1997 | Ellwood et al. . | |

* cited by examiner

*Primary Examiner*—Jeffery Hofsass
*Assistant Examiner*—Son M. Tang
(74) *Attorney, Agent, or Firm*—R. Christian Macke

(57) ABSTRACT

A smoke detector test device comprising a stamped plate. Combustible elements are positioned and retained on the stamped plate which, when ignited smolder to provide smoke of sufficient volume to actuate a properly functioning smoke alarm without requiring or causing an open flame. The stamped plate has an aperture and inwardly projecting flanges that allow the plate to be effectively attached to a broom handle to give a user extended reach to place the device, and smoke generated thereby, in close proximity to the smoke detector. A method for forming the smoke detector test device is also disclosed.

13 Claims, 3 Drawing Sheets

SMOKE DETECTOR TEST DEVICE AND METHOD FOR MANUFACTURE

FIELD OF THE INVENTION

This invention relates to a portable device for testing the operation of a smoke detector by safely producing smoke in close proximity to a smoke detector to be tested.

BACKGROUND OF THE INVENTION

The number of fires in residences and businesses and the destruction caused thereby have resulted in the pervasive use of smoke detectors and smoke detection systems that provide early warning of a fire or dangerous condition by sensing smoke and sounding an audible alarm. Since 1969, when the first commercial smoke detectors became readily available, the number and type of smoke detectors have increased exponentially. While the vast majority of residences and commercial buildings are, in fact, now equipped with some kind of smoke detectors, that alone has not eliminated the problems or destruction resulting in fires, even in buildings in which smoke detectors are installed. Fire remains the second leading cause of death in the home, with over 3,500 deaths and billions of dollars in property damage attributable thereto annually.

In the last 30 years, smoke detector design and functioning have improved, and the latest incarnation of smoke detectors now are guaranteed by the manufacturer to be effective for 10 years on the condition that the batteries are properly maintained, while previously only a 3 year warranty was available. Most of the smoke detectors presently in use have outlived their warranties and useful life, however, and may be defective, although the homeowner is unaware of the defect. The confirmation and ramifications of the gradual failure of smoke detectors is underscored by a trend indicating that, while the number of total fire damage and death is decreasing, probably due to the use of smoke detectors, the instances of fires in which smoke detectors failed is increasing. That is, the National Fire Data Center, a division of the Federal Emergency Management Agency, has determined that the number of instances of fires where an alarm was present but did not operate is increasing. The present invention is dedicated to reversing this trend by making the testing of smoke detectors less expensive and easier and safer to accomplish.

The operation of most smoke detectors relies upon the life of a battery installed therein. Generally, smoke detectors work in one of two ways. Some smoke detectors work by sensing the presence of particulates in smoke by detecting an interruption in photoelectric energy, i.e. a beam of light is interrupted, while others employ the use of an ionization of an air sample to detect smoke. In both the photocell and ionization smoke detectors, an audible alarm mounted within the smoke detector housing is triggered upon the detection of smoke. Because the photoelectric/ionization detection circuit and the audible alarm circuit require a power supply for operation, the power supply generally supplied by an on-board battery, the operation and effectiveness of the smoke detector is completely dependent upon the integrity and life remaining in the battery. While other defects in the detection and alarm circuits could still prevent effective operation of the smoke detector, as discussed in more detail below, the failure of the battery would render the smoke detector useless. Thus there is defined a need for a device that tests the operation of a smoke detector, including the integrity and life left in the battery providing power to the smoke detector.

One method for testing smoke detectors and particularly for testing the life of the battery therein is to bypass the photoelectric detection circuit to test the audible alarm circuit. Most often this test is done by pressing a button mounted on the smoke detector itself which, effectively, bypasses the detection circuit and triggers the alarm to sound. For a number of reasons this method for testing a smoke detector is disadvantageous. First, smoke detectors are generally mounted high on walls or on a ceiling, away from the floor, and they are not readily accessible for a user to test in this manner. To operate the test button on a smoke detector a user often must elevate himself and reach up to push the test button. Climbing on a ladder or chair or using other means for elevation or to reach the button on a high mounted smoke detector presents an increase risk of injury from falling, is inconvenient and requires the user to have a ladder or other device on which he can elevate himself available.

In addition, the test of a smoke detector by depressing the on-board button merely tests the operation of the audible alarm circuit by bypassing the photoelectric/ionization detection circuit. It does not test the sensitivity or operation of the photoelectric/ionization detection circuit. A problem in the photoelectric/ionization detection circuit, such as a bad photoelectric sensor or ionization chamber, or one that is not operating properly due to dust accumulated thereon, would not be evident by operation of the test button. That is, the test button could still close the circuit and trigger the audible alarm even if the photoelectric/ionization sensor was completely defective, and the user would mistakenly believe that the smoke detector was operating properly.

It is desirable to provide a device for testing the operation of a smoke detector, including the life of the battery and the operation of the detection and alarm circuits, by simulating the conditions under which the detector is designed to operate. The controlled creation of smoke in close proximity to the smoke detector is effective as a means to test a smoke detector, but it is desirable to do so without requiring the use of an open flame near the smoke detector since a flame presents an increased risk of damage or injury if the flame is positioned too close to the smoke detector or the wall or ceiling on which it is mounted. Preferably a smoke detector test device would generate smoke in the vicinity of the smoke detector by causing a combustible substance to smolder for a very short period of time without creating a flame, thereby creating smoke in sufficient volume to be perceived by the smoke detector which then triggers audible alarm to be activated. To make the use of such a test device safe, the user should be able to place it in close proximity to the smoke detector without requiring the user to position himself near the smoke detector, as on a ladder or stool, which is inconvenient and presents an increased risk of falling and injury.

Most manufacturers recommend testing of smoke detectors every 30 days. Recently government sponsored programs have sought to encourage testing of smoke detectors one to two times per year. With the use of a smoke detector test device as infrequently as once or twice a year, it would be advantageous to provide a smoke detector test device that is inexpensive to manufacture and operate so that a one time use of the device is reasonable. An inexpensive device with a combustible element affixed thereto that smolders when ignited, without creating or resulting in an open flame being present, and one which is readily attached to a broomstick or other extended handle commonly found around the home, would serve such purpose effectively and inexpensively. Such device would also be a true test of the operation of the smoke detector and thereby overcomes the disadvantages of the prior art. A goal of a simple and inexpensive test device is to make the testing of smoke detectors every 30 days feasible.

U.S. Pat. No. 4,271,693 to Bute provides a telescoping smoke detector test device which includes a smoldering tip that is ignited by an electric supply mounted thereon. The telescoping arm can be extended so that the smoldering tip is sufficiently near the smoke detector to trigger its operation if the detector is working properly. The '693 Bute device is disadvantageous, however, because of the complexity of the manufacturing and assembly of the device. The inclusion of a telescoping extensible arm and an electric source wired to ignite the smoldering tip can be dramatically simplified by merely providing a combustible element on a carrier that can then be quickly and easily attached to a rod, such as a broomstick or mop handle, without requiring the need for a telescoping extensible arm or battery operated ignition.

There is thus identified a need for a smoke detector test device that is simple to manufacture and assemble and that provides means for smoke generation without requiring or resulting in an open flame. The device is utilized by first attaching it to a broomstick or other rod to provide greater reach for the user, then igniting the combustible material mounted on the device which smolders to create the desired smoke, and then positioning the device near the smoke detector. Such device is simple and inexpensive and provides a means for completely testing the operation of a smoke detector, including the photoelectric/ionization sensor and the audible alarm, without requiring the user to climb a ladder to get close to the detector.

OBJECTS OF THE INVENTION

It is an object of the present invention to provide a smoke detector test device that provides a complete test of a smoke detector by creating the conditions under which the smoke detector is designed to operate.

It is another object of the present invention to provide a smoke detector test device that creates smoke to trigger the smoke detector without requiring or resulting in the presence of an open flame.

It is yet another object of the present invention to provide a smoke detector test device that is inexpensive to manufacture and operate.

It is a further object of the present invention to provide a smoke detector test device that is attached to an extended rod to allow a user to position the device near a smoke detector without requiring a ladder or stool or other device to elevate the user.

It is a further object of the present invention to provide a smoke detector test device having combustible elements secured thereto and an ash tray for retaining ashes from the consumed combustible elements.

It is yet another object of the present invention to provide a smoke detector test device having a simple and effective means for attachment to a broomstick or other extended rod commonly found in the home.

It is another object of the present invention to provide a simple and inexpensive method for manufacturing a smoke detector test device that is readily attached to a rod and which securely retains a combustible element therein.

It is a further object of the present invention to provide a method for forming a smoke detector test device by stamping thin sheets of metal to form means for attaching to a rod, means for securely retaining combustible elements thereon, and means for capturing and retaining ashes of the consumed combustible elements.

These and other objects and advantages of the present invention will be apparent from a review of the following specification and accompanying drawings.

SUMMARY OF THE INVENTION

The smoke detector test device of the present invention comprises a plate on which at least one combustible element is held, the plate having means for holding the combustible element thereon. The plate also has means for attaching the plate to a rod. The present invention, which merely comprises the plate, is used in conjunction with an extension rod routinely found in the home, such as a broomstick or mop handle, so that a user can position the plate in close proximity to the smoke detector being tested without requiring the user to climb a ladder or stand on a chair or stool.

The present smoke detector test device also includes an ash tray for retaining ashes as the combustible element is consumed. The means for holding the combustible element, comprising at least one cup formed in the plate, is positioned within the ash tray so that waste material comprising consumed portions of the combustible element are retained in the ash tray.

The means for attaching the smoke detector test device to a rod preferably includes inwardly projecting flanges that assist in securing the plate to a specific position on the rod. In the most preferred embodiment of the present invention the plate is an elongated strip and the attaching aperture is near one end of the plate while the ash tray is near the other end.

The smoke detector test device utilizes at least one short length of incense as the combustible element that is retained in the cup formed in the plate. In the most preferred embodiment of the present invention two short lengths of incense are provided and secured to the plate and are ignited simultaneously to ensure that sufficient smoke is produced to be detected by the smoke detector.

The most preferred embodiment of the present invention also includes a cap that can be positioned over the ash tray to extinguish the smoldering combustible elements. The cap also will prevent ashes from the combustible elements retained in the ash tray from spilling. Replacement lengths of combustible elements are attached to the plate, being secured thereto by raised teeth. When the combustible elements positioned within the ash tray are fully consumed, the replacement combustible elements are immediately available so it is not necessary to go looking for replacements.

The principles of the present invention also contemplate the method for forming the smoke detector test device described above. A generally elongated and flat plate is stamped to, first, form an aperture which provides a means for attaching the plate to a rod, and, second, to form an ash tray, as well as at least one cup within the ash tray to securely hold the combustible element. The smoke detector test device is also stamped to provide means for retaining replacement combustible elements to be utilized when the combustible elements positioned in held in the cups are fully consumed. In the most preferred embodiment of the present invention, the aperture for attaching the plate to the rod includes inwardly projecting flanges that engage the rod and function to hold the plate in place.

The stamping of the plate of the smoke detector test device of the present invention may be effected in a single step, as in a metal stamping press, to transform a sheet of thin, flat metal, such as tin, into a plate having an aperture having inwardly projecting flanges, an ash tray and at least one cup formed within the ash tray which securely holds the length of combustible material.

DETAILED DESCRIPTION OF THE INVENTION

The most preferred embodiment of the smoke detector test device 10 of the present invention comprises a plate 11 having various provisions formed therein to facilitate its use to check the operation of battery operated smoke detectors in a house or other building. The smoke detector test device 10 tests the operation of a smoke detector by providing a source of smoke in close proximity to a smoke detector. The use of the smoke detector test device 10 of the present invention is advantageous compared to the typical test button found on a smoke detector which merely triggers an audible alarm to operate but does not test the functioning of the smoke detector to sense the presence of smoke. The smoke detector test device 10 is a device which fully tests the function of a smoke detector by creating the conditions, a smoky environment, that should trigger the smoke detector alarm when it is working properly.

Figure 3:
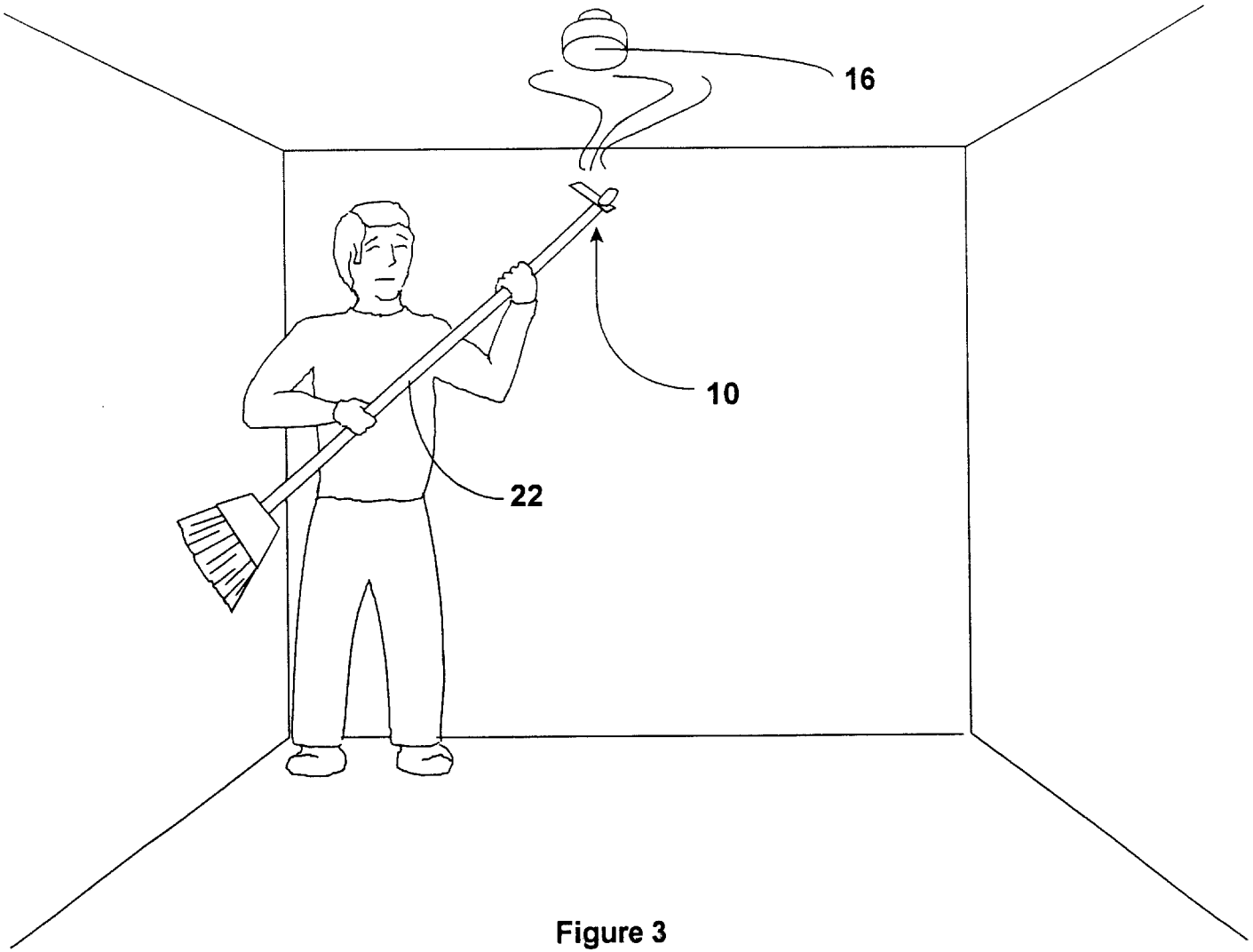
FIG. 3 is an illustration of the smoke detector test device of the present invention as used to verify the operation of a ceiling mounted smoke detector.

The smoke detector test device 10 of the present invention has combustible elements 12, 14 mounted thereon. When ignited, the combustible elements 12, 14 smolder rather than flaming to create smoke which, when the smoke detector test device 10 is positioned near a smoke detector 16 (FIG. 3), triggers the operation and activation of the alarm on the smoke detector 16.

The combustible elements 12, 14 each comprise a short length of incense that are retained in cups 18,20 that are formed in the plate 11. In addition to providing a combustible substance that smolders to create smoke rather than flaming, the incense has the added benefit of providing a pleasing odor during the testing of the smoke detector. The cups 18,20 comprise hollow cylinders formed from the plate 11. The combustible element retaining cups 18, 20 are formed so that the inside diameter is slightly smaller than the incense comprising the combustible elements 12, 14 so that the combustible elements 12, 14, which are slightly compressable, can be pushed into the cups 18, 20 and will be securely retained therein. This allows a user to position the smoke detector test device 10 near a smoke detector without requiring the user to keep the smoke detector test device 10 level to avoid spilling of the combustible substance.

Figure 2:
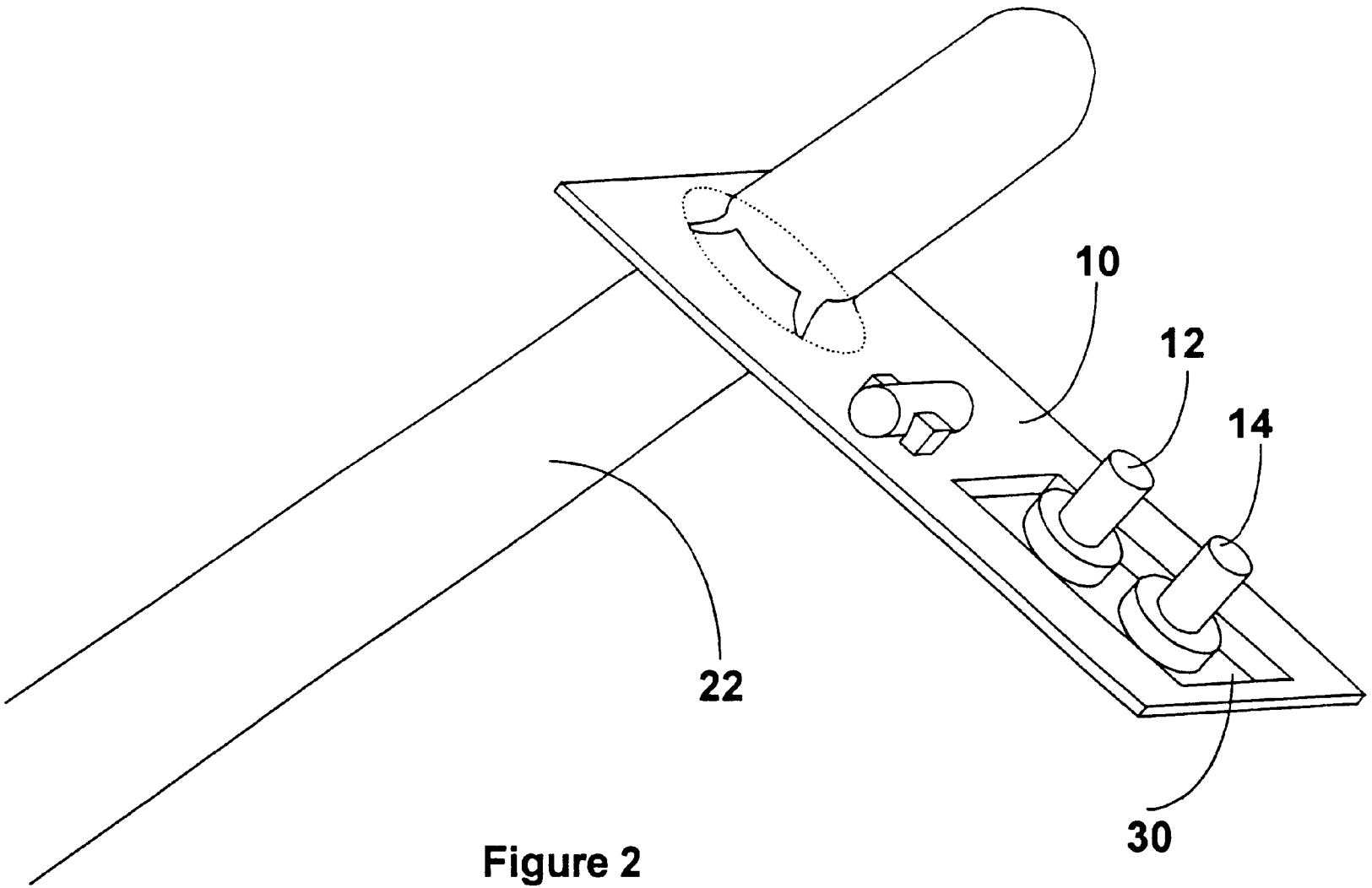
FIG. 2 is an illustration of the smoke detector test device of the present invention attached to a rod.

The plate 11 of the smoke detector test device 10 is used in conjunction with an extension rod 22, such as a broomstick or mop handle, that is commonly found around the house. The plate 11 includes an aperture 24 located near one end 25 of the plate, the aperture 24 being engaged by the rod 22 as shown in FIG. 2. The smoke detector test device 10 is maintained in a fixed position on the rod 22 by frictional flanges 26 formed in the plate 11. In the most preferred embodiment of the present invention four flanges 26*a*,26*b*,26*c*,26*d* are formed in the plate around a central aperture 24 and are separated by slots 28*a*,28*b*,28*c*,28*d*. When engaged by the rod 22, the flanges 26*a*,26*b*,26*c*,26*d* spread out and engage the rod 22 as shown in FIG. 2. The flanges 26*a*,26*b*,26*c*,26*d* are initially flat and coplanar with the plate 11. As the rod 22 is extended through the aperture 24, causing the flanges 26*a*,26*b*,26*c*,26*d* to separate around the rod 22, resilience to bending causes the flanges 26*a*,26*b*,26*c*,26*d* to exert an inward force on the rod 22, and the friction between the flanges 26*a*,26*b*,26*c*,26*d* and the rod 22 thereby prevents translation of the plate 11 on the rod 22. While the preferred embodiment contemplates the use of four flanges separated by four slots, more or less flanges that operate to close on and around an extension rod are specifically contemplated and do not depart from the principles After the testing is complete, the smoke detector test device 10 is removed from the rod 22 by over-bending the flanges 26*a*,26*b*,26*c*,26*d* outwardly so that the smoke detector test device 10 easily slides off the rod 22. After removing the smoke detector test device 10 from the rod 22, the flanges 26*a*,26*b*,26*c*,26*d* are folded back in to again be coplanar with the plate 11 to restore its resilience that creates the frictional contact with the rod 22 that allows it to be held in place on the rod 22.

An indentation functioning as an ash tray 30 is formed in the smoke detector test device 10 near the end 31 opposite the aperture 24. The ash tray 30 surrounds the cups 18,20 that hold the combustible elements 12,14 so that, as the combustible elements 18,20 are consumed, the ashes fall into and are retained in the ash tray 30. To prevent any spillage of the ashes from the ash tray 30, a removably positioned cap 32 is provided that locks into the ash tray 30. When the ashes have cooled, the smoke detector test device 10 is turned upside down so that the ashes fall into the cap 32, from which they may be disposed. The cap 32 provides the further benefit of cutting off air to the combustible elements 12,14 so that application of the cap 32 extinguishes the burning consumption of the combustible elements 12,14.

Figure 1:
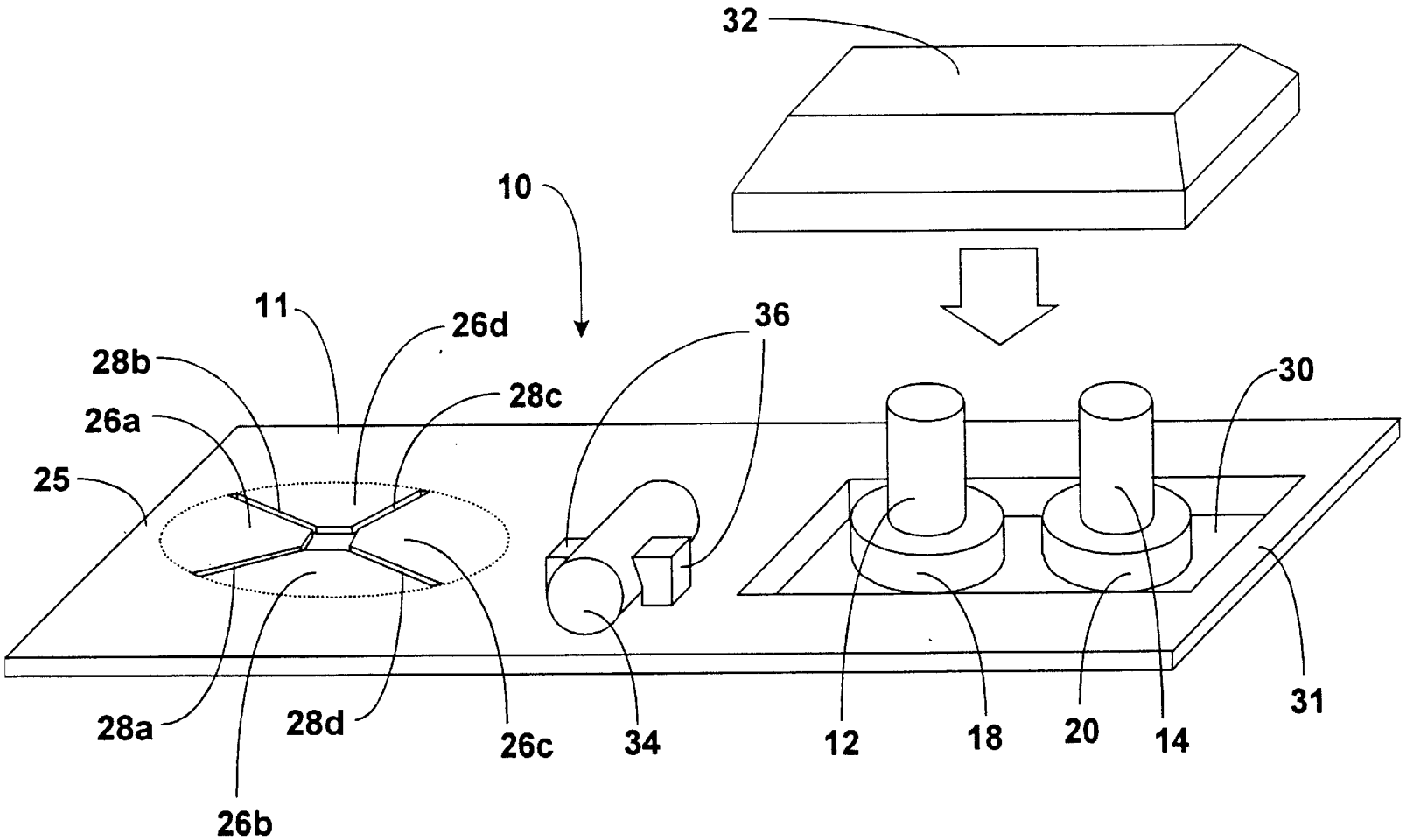
FIG. 1 is a perspective view of the smoke detector test device of the present invention.

Because the combustible elements 12,14 are consumed during the use of the smoke detector test device 10, the principles of the present invention contemplate the inclusion and mounting of replacement combustible elements 34 on the plate 11. Teeth 36 provide a means for retaining replacement combustible elements on the plate 11. The teeth 36 extend from the plate 11 and are spaced such that they hold the combustible element 34 securely between them. When either combustible element 12,14 is fully consumed, the replacement combustible element 34 is readily inserted into the cups 18,20 so that no search is necessary to locate replacement elements. While FIGS. 1 and 2 show a single replacement element 34, it is specifically contemplated by the principles of this invention that multiple replacement elements may be provided and positioned on the plate 11 without departing from the principles of this invention.

The smoke detector test device 10 of the present invention comprises a simple device that is formed from a plate 11 that is, in the most preferred embodiment, a sheet of thin, solid metal. The plate 11 is stamped to form an aperture 24 through which an extension rod can be inserted to allow a user to position the smoke detector test device 10 near a smoke detector without requiring the user to be in close proximity thereto.

The plate 11 is also stamped to form the cups 18,20 in which combustible elements 12,14 are secured. The cups 18, 20 are formed within the ash tray 30 so that consumed ashes from the combustible elements 12,14 fall into and are retained in the ash tray 30.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

I claim:

1. A smoke detector test device comprising:

a plate:

at least one combustible element;

means for holding said at least one combustible element on said plate;

means for attaching said plate to an extension rod;

an ash tray formed in said plate, said holding means being positioned within said ash tray;

wherein said attaching means comprise an aperture having inwardly projecting flanges; and wherein said aperture is large enough for a broomstick to pass through.

2. The smoke detector test device of claim 1 wherein said plate has a first end and a second end and said aperture is near said first end of said plate and said ash tray is near said second end of said plate.

3. The smoke detector test device of claim 2 wherein said at least one combustible element comprises a short length of incense.

4. The smoke detector test device of claim 3 wherein said holding means comprises at least one cup formed in said plate within said ash tray.

5. The smoke detector test device of claim 4 wherein said at least one combustible element comprises two combustible elements.

6. The smoke detector test device of claim 5 wherein said at least one cup comprises two cups.

7. The smoke detector test device of claim 6 further comprising:

a cap removably positioned over said ash tray.

8. The smoke detector test device of claim 7 further comprising:

at least one replacement combustible element held on said plate by teeth extending from said plate.

9. The smoke detector test device of claim 8 wherein an inside diameter of said cup is smaller than said incense.

10. A method for forming a smoke detector test device comprising the steps of:

providing a plate;

stamping said plate to form an aperture to provide a means for attaching said plate to a rod;

stamping said plate to form an ash tray therein;

stamping said plate to form at least one cup to retain a combustible element therein.

11. The method for forming a smoke detector test device of claim 10 further comprising the step of:

stamping said plate to provide means for retaining replacement combustible elements thereon.

12. The method for forming a smoke detector test device of claim 11 wherein said stamping said plate to form an aperture further comprises the step of stamping said plate to form an aperture further comprises stamping said plate to form an aperture having inwardly projecting flanges.

13. The method for forming a smoke detector test device of claim 12 steps of stamping said plate to form an aperture to provide a means for attaching said plate to a rod; stamping said plate to form an ash tray therein; stamping said plate to form at least one cup to retain a combustible element therein; and stamping said plate to provide means for retaining replacement combustible elements thereon occur simultaneously.

* * * * *